US006389638B1

(12) United States Patent
Dickinson et al.

(10) Patent No.: US 6,389,638 B1
(45) **Date of Patent: *May 21, 2002**

(54) CONTAINER ASSEMBLY

(76) Inventors: Thomas Dickinson, 12401 Balwyck, St. Louis, MO (US) 63131; Bradley D. Gale, 2731 Ridgeway Ave., Greece, NY (US) 14626

( * ) Notice: Subject to any disclaimer, the term of this patent is extended or adjusted under 35 U.S.C. 154(b) by 0 days.

This patent is subject to a terminal disclaimer.

(21) Appl. No.: 09/685,711

(22) Filed: Oct. 10, 2000

Related U.S. Application Data

(63) Continuation of application No. 09/208,176, filed on Dec. 9, 1998, now Pat. No. 6,128,803.

(51) Int. Cl.[7] ..... A47L 13/59; A47L 13/146
(52) U.S. Cl. ..... 15/261
(58) Field of Search ..... 15/260, 261, 262, 15/263, 264; 100/131, 133, 134, 135, 125, 293; 68/239, 241, 244, 245

(56) References Cited

U.S. PATENT DOCUMENTS

| | | | | |
|---|---|---|---|---|
| 1,149,530 A | | 8/1915 | Markovich | |
| 1,234,721 A | | 7/1917 | Boggess | |
| 2,290,217 A | * | 7/1942 | Trindl et al. | 15/261 |
| 4,047,261 A | | 9/1977 | Rones | |
| D255,976 S | | 7/1980 | Maza et al. | |
| D270,961 S | | 10/1983 | Hawkins et al. | |
| D320,295 S | | 9/1991 | Delmercio | |
| D338,299 S | | 8/1993 | Delmercio et al. | |
| D345,236 S | | 3/1994 | Chen | |
| 5,440,778 A | | 8/1995 | De Guzman | |
| D374,321 S | | 10/1996 | Mandell et al. | |
| 5,608,942 A | | 3/1997 | Disbrow | |
| 5,615,447 A | | 4/1997 | Hardesty et al. | |
| 5,918,343 A | | 7/1999 | Young | |
| 6,028,803 A | | 10/2000 | Dickinson et al. | |

* cited by examiner

*Primary Examiner*—Robert J. Warden, Sr.
*Assistant Examiner*—Kaj K. Olsen
(74) *Attorney, Agent, or Firm*—Thompson Coburn LLP

(57) ABSTRACT

A container assembly includes a one piece container body and a press member connected to the container body. The container body includes a bottom wall and a plurality of side walls extending upwardly from the bottom wall to define a liquid reservoir. One of the side walls includes a wringing surface. The press member is operatively connected to the container body for movement of the press member between a wringing position and a non-wringing position relative to the wringing surface of the container body. The press member and the wringing surface define a mop receiving volume. The mop receiving volume has a volume $V_1$ when the press member is in its non-wringing position and a $V_2$ when the press member is in its wringing position. The volume $V_2$ is less than the volume $V_1$. The press member and the wringing surface are configured to wring liquid out of a mop upon movement of the press member from its non-wringing position toward its wringing position when a mop head is positioned between the press member and wringing surface.

18 Claims, 9 Drawing Sheets

CONTAINER ASSEMBLY

This is a continuation of application Ser. No. 09/208,176; filed on Dec. 9, 1998 New U.S. Pat. No. 6,128,803.

BACKGROUND OF THE INVENTION

This invention relates generally to the field of portable container assemblies and, more particularly, to portable container assemblies having integral wringing mechanisms for wringing liquid out of a mop.

The use of portable container assemblies, including bucket-like containers, in connection with various cleaning activities is well known in the art. Typically, such assemblies include a bucket-like container that defines a reservoir for holding cleaning solutions or other liquids. Such container assemblies often include wheels or casters to facilitate movement of the container assembly across various surfaces.

In general, mop wringers are also known in the art. Conventional mop wringers are positionable on the rim or edge of a side wall of a bucket-like container, and include a hopper that is designed to receive a mop head. Generally, these mop wringers are adapted for engagement with the mop head in a manner for wringing liquid from the mop head and into the reservoir. Typically, mop wringers include one or more press members or press "plates" that engage the mop head in a manner to "squeeze" liquid therefrom. Commonly, these mop wringers include a lever arm that is operatively connected to one of the press members. Movement of the lever arm effectuates movement of the press member toward and against the mop head to squeeze liquid from the mop head.

Conventional mop wringers are constructed independently of their associated containers and, in general, are not integral with the containers. Rather, these prior art mop wringers typically include a pair of generally parallel flanges that extend downwardly from the body of the wringer, each of the flanges having a generally vertical slot adapted to receive the upper edge of the rim of the container to which the wringer is to be mounted. These vertical slots allow the user to mount the wringer to the container by resting the wringer on the rim of the container with the rim received within the slots. The wringer is removable from the container by simply lifting the wringer upwardly from the rim.

Although the container assemblies and mop wringers described above have proven to be useful and functional, certain shortcomings prevent them from representing an ideal solution. A problem with conventional container assemblies is that the mop wringers and the containers themselves may become separated from one another and, consequently, one or the other may be misplaced. Another problem with container assemblies having separable mop wringers is instability of the mop wringer. In most applications, a substantial amount of force is required to wring liquid from the mop head and, accordingly, the lever arm of the wringer must be long enough to provide sufficient leverage. As described above, many prior art mop wringers are mounted to their associated containers by simply resting the wringer on the rim of the container with the rim received within the U-shaped slots of the wringer. When substantial forces are applied to the lever arm, this mounting arrangement may be unstable and, therefore, unsafe. Noise is another problem with conventional mop wringers that are not integral with their associated containers. Loose wringers tend to rattle or bang against the container while in use or in transport.

SUMMARY OF THE INVENTION

The present invention pertains to a container assembly having features and advantages that overcome problems encountered in the prior art. The container assembly features an integral container and wringing mechanism, which provides greater stability during operation of the wringing mechanism. The integral construction of the container and wringing mechanism is also advantageous because it generates less noise during use, and makes it impossible to inadvertently separate the container and wringing assembly from one another.

In general, a container assembly of the present invention comprises a one-piece container body and a press member connected to the container body. The container body includes a bottom wall and a plurality of side walls extending upwardly from the bottom wall to define a liquid reservoir. One of the side walls includes a wringing surface. The press member is operatively connected to the container body for movement of the press member between a wringing position and a non-wringing position relative to the wringing surface of the container body. The press member and the wringing surface define a mop receiving volume. The mop receiving volume has a volume $V_1$ when the press member is in its non-wringing position and a volume $V_2$ when the press member is in its wringing position. The volume $V_2$ is less than the volume $V_1$. The press member and the wringing surface are configured to wring liquid out of a mop upon movement of the press member from its non-wringing position toward its wringing position when a mop head is positioned between the press member and wringing surface.

In another aspect of the present invention, a container assembly comprises a container body and a wringing mechanism. The container body includes a bottom wall and a plurality of side walls extending upwardly from the bottom wall to define a liquid reservoir. The wringing mechanism is adjacent the liquid reservoir and is adapted for wringing liquid out of a mop. At least one of the side walls of the container body and at least a portion of the wringing mechanism are of a monolithic construction.

In yet another aspect of the present invention, a container assembly comprises a container body and a wringing mechanism. The container body is configured to define a liquid reservoir. The wringing mechanism is adapted for wringing liquid out of a mop. The container body and at least a portion of the wringing mechanism are of a unitary construction.

Other advantages and features of the present invention will be in part apparent and in part pointed out hereinafter.

BRIEF DESCRIPTION OF THE DRAWINGS

Corresponding references characters indicate corresponding parts throughout the several views of the drawings.

DETAILED DESCRIPTION OF THE PREFERRED EMBODIMENTS

Figure 1:
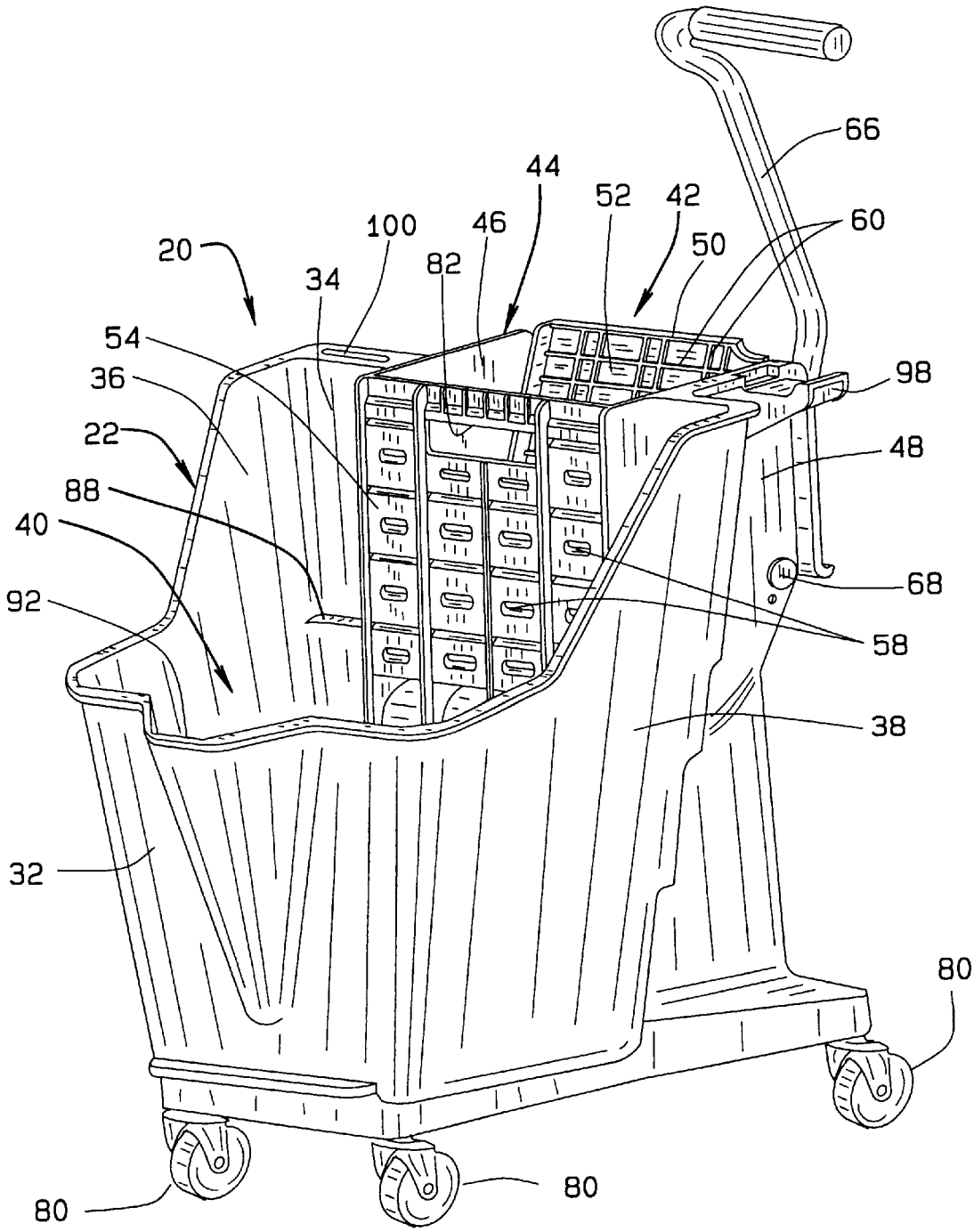
FIG. 1 is a front and right side perspective view of a container assembly of the present invention shown with a wringing mechanism in a non-wringing position.

A container assembly of the present invention is represented in its entirety in the Figures by the reference numeral 20. In general, the container assembly 20 is comprised of a one-piece container body 22 having a bottom wall 30 and four reservoir side walls (i.e., a forward reservoir wall 32, a back reservoir wall 34, a left side reservoir wall 36 and a right side reservoir wall 38). The four reservoir side walls 32, 34, 36 and 38 extend upwardly from the bottom wall 30 to define a liquid reservoir 40.

The container assembly 20 further comprises an integral wringing mechanism, represented generally in the Figures by the reference numeral 42, adjacent the liquid reservoir 40. As described below, the wringing mechanism 42 is adapted for wringing liquid out of a mop (not shown). The wringing mechanism 42 includes a mop-receiving hopper 44. The hopper 44 is defined by the back reservoir wall 34 of the container body 22, a pair of opposing hopper side walls 46 and 48, and a movable press member 50. The hopper side walls 46 and 48 extend generally rearwardly from the back reservoir wall 34. The press member 50 is pivotally connected to the container body 22 for generally pivoting movement of the press member 50 between a non-wringing position (shown in solid lines in the Figures) and a wringing position (shown in phantom in FIGS. 2 and 10) relative to the back wall 34. As shown in the Figures, the bottom wall 30, the forward reservoir wall 32, the back reservoir wall 34, the left and right side reservoir walls 36 and 38, and the hopper side walls 46 and 48 are preferably all of a monolithic construction, with the back reservoir wall 34 defining a portion of the liquid reservoir 40 as well as a portion of the mop-receiving hopper 44.

Preferably, the container body 22 and press member 50 are molded of a suitable high-density polymeric material with smooth surfaces having no significant porosity to harbor bacteria. In general, such polymeric materials are relatively lightweight, easy to clean, and not subject to corrosion. As shown in the Figures, the preferred embodiment of the container body 22 is proportionally taller than conventional mop buckets. This taller profile is ergonomically more efficient than conventional mop buckets and reduces lower back strain caused by bending during mopping. The taller profile also provides a taller "column" of water in the liquid reservoir 40 than the more shallow conventional buckets. The taller column of water allows dirt and sediment to settle to the bottom of the reservoir 40, leaving the water near the top of the reservoir cleaner for a longer period of time. The container assembly 20 may also include a removable sediment screen (not shown) spaced just above the bottom of the liquid reservoir 40 to keep the water above the screen cleaner for longer. The taller profile also reduces the likelihood that water contained in the reservoir 40 will slosh over the sides.

Figure 10:
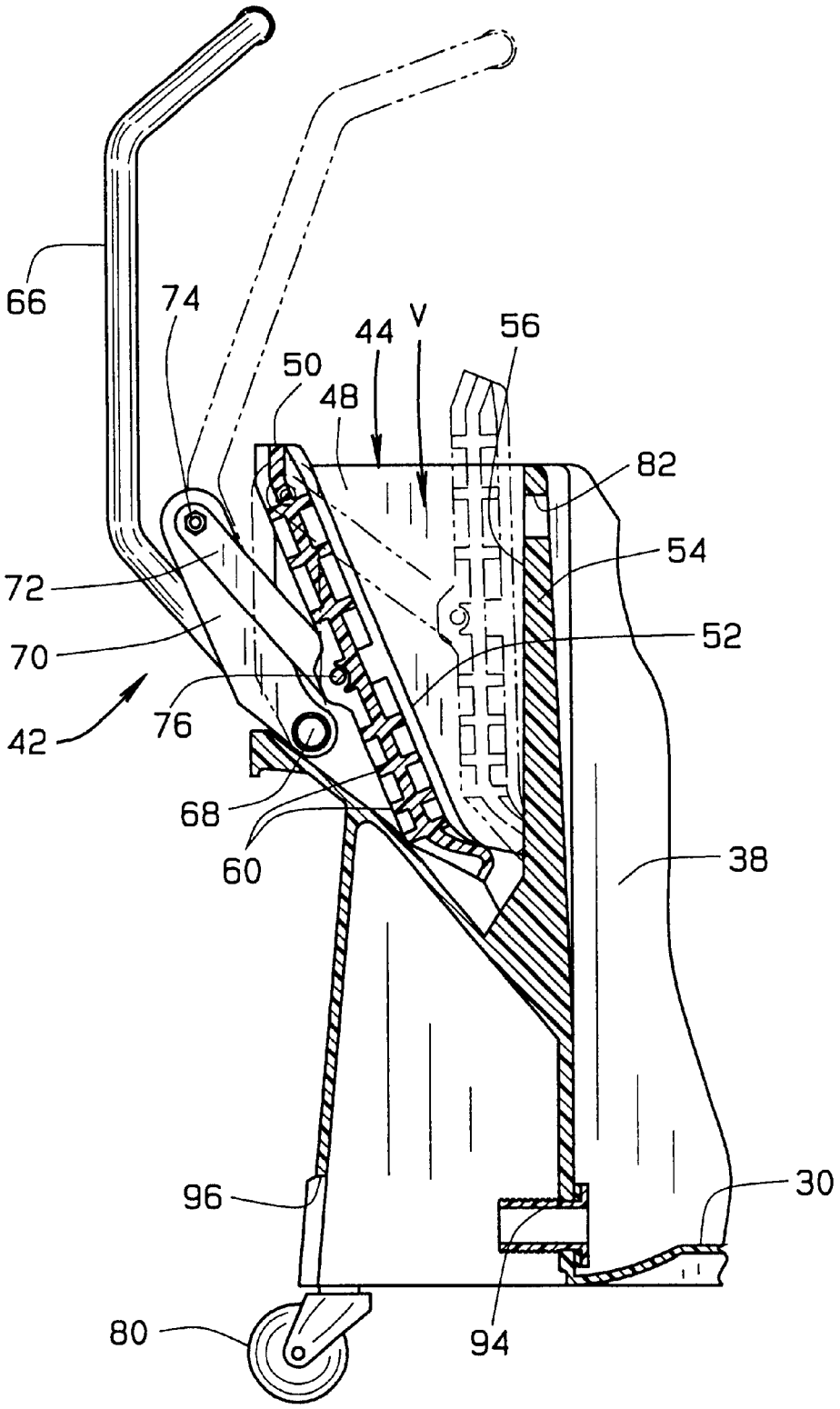
FIG. 10 is a cross-sectional view of the container assembly of FIG. 1 taken along the plane of line 10—10 of FIG. 7, with the non-wringing position of the wringing mechanism shown in solid lines and with the wringing position of the wringing mechanism represented by phantom lines.

The press member 50 includes a pressing surface 52, and the back reservoir wall 34 includes a central wringing wall 54 with a wringing surface 56 facing into the hopper 44. The pressing surface 52, the hopper side walls 46 and 48 and the wringing surface 56 define a mop receiving volume V within the hopper 44. The mop receiving volume V has a volume $V_1$ when the press member is in its non-wringing position (shown in solid lines in the Figures) and a volume $V_2$ when the press member is in its wringing position (shown in phantom in FIGS. 2 and 10). As best shown in FIG. 10, the volume $V_2$ is less than the volume $V_1$. Thus, the pressing surface 52 of the press member 50 and the wringing surface 56 of the wringing wall 54 are configured to wring liquid out of a mop upon movement of the press member 50 from its non-wringing position toward its wringing position when a mop head is positioned within the mop receiving volume V between the pressing surface 52 and the wringing surface 56.

Preferably, the back reservoir wall 34 includes a plurality of drain apertures 58. The apertures 58 are adapted to permit liquid to pass through the back reservoir wall 34 as the press member 50 is moved toward its wringing position to evacuate liquid from a mop head. The apertures 58 provide fluid communication between the mop-receiving volume V and the liquid reservoir 40. Thus, during movement of the press member 50 toward the wringing surface 56, water in the mop is "squeezed" out of the mop head and forced out of the hopper 44 through the apertures 58 into the liquid reservoir 40. Preferably, the pressing surface 52 of the press member 50 includes a plurality of mop-engaging projections 60. The projections 60 are adapted for engaging a mop head when the press member 50 is being moved toward the wringing surface 56. The projections aid in gripping the mop head between the pressing surface 52 and the wringing surface 56 while squeezing water therefrom.

The press member 50 includes a pair of downwardly extending pivot legs 62 and the back reservoir wall 34 includes a pair of pivot sockets 64 adapted to receive distal ends of the legs 62 in a manner to permit generally pivoting movement of the press member 50 relative to the wringing surface 56 of the wringing wall 54. The container assembly 20 further comprises a rotatable lever arm 66 pivotally connected to the hopper side walls 46 and 48 by a pivot shaft 68, the outer ends of which are journalled in the hopper side walls 46 and 48 for rotating movement relative thereto. The shaft 68 also carries two throw arms 70 generally adjacent its outer ends. A distal end of each throw arm 70 is connected to one end of a link arm 72 by a pin 74 for pivoting movement of the link arms 72 relative to the throw arms 70. An opposite end of each link arm 72 is pivotally connected to the press member 50 by a rod 76 for pivoting movement of the link arms 72 relative to the press member 50. Thus, the throw arms 70, link arms 72, press member 50 and container body 22 provide a mechanically efficient four-bar mechanism for operating the wringing mechanism 42. In operation, movement of the lever arm 66 relative to the container body from a first position (shown in solid lines in the Figures) toward a second position (shown in phantom in FIGS. 2 and 10) causes movement of the press member 50 from its non-wringing position toward its wringing position.

The container assembly 20 may also include other features that help to increase working efficiency. Preferably, the container assembly 20 includes four standard casters 80 positioned at the corners to facilitate movement of the container assembly 20 across various work surfaces. As shown in FIGS. 1, 3, 9 and 10, the back reservoir wall 34 includes a built in handle 82 that is located at the center of gravity of the container assembly 20 to provide for stable and comfortable lifting of the assembly.

Figure 7:
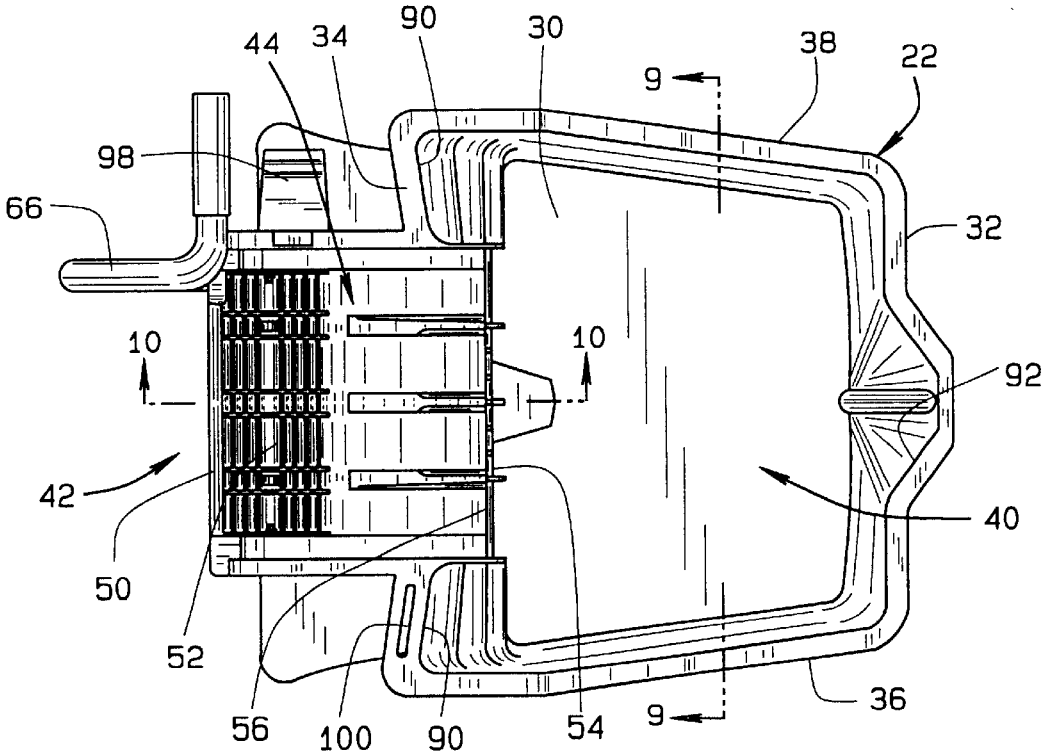
FIG. 7 is a top plan view of the container assembly of FIG. 1.
Figure 8:
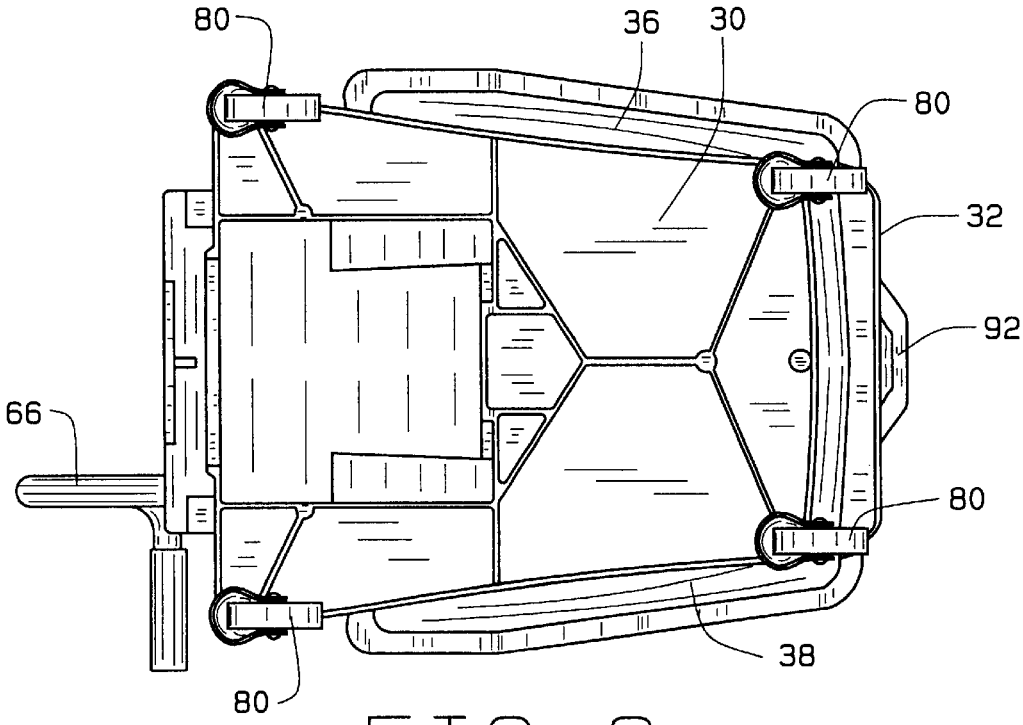
FIG. 8 is a bottom plan view of the container assembly of FIG. 1.
Figure 9:
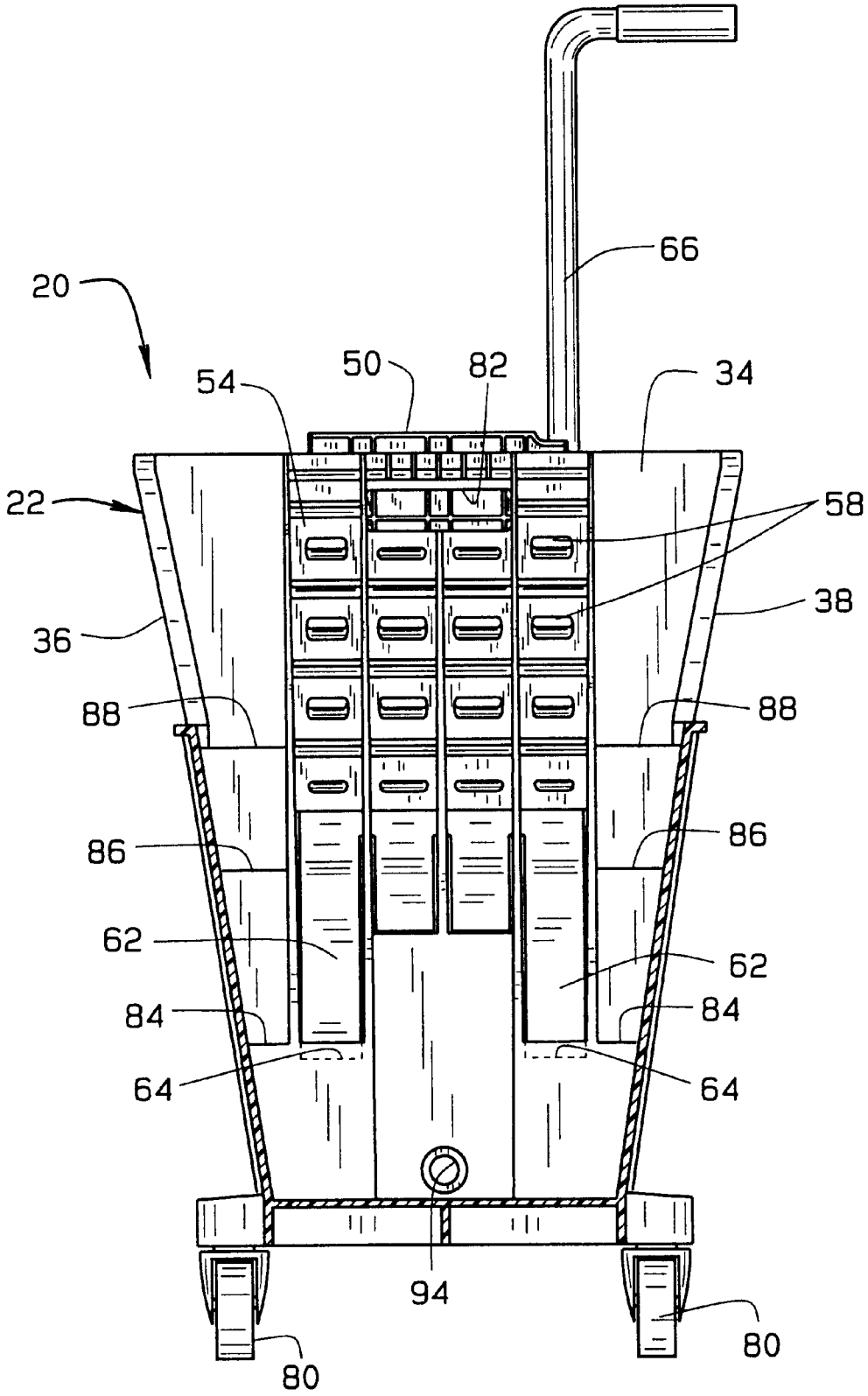
FIG. 9 is a cross-sectional view of the container assembly of FIG. 1 taken along the plane of line 9—9 of FIG. 7.

As shown in FIG. 9, the back reservoir wall 34 also includes steps 84, 86 and 88, which serve to indicate liquid fill measurements. As best shown in FIG. 7, the back reservoir wall 34, wringing wall 54 and left side reservoir wall 36 define a built-in recess 90 adapted for holding a mop stick (not shown) generally upright. The back reservoir wall 34, wringing wall 54 and right side reservoir wall 38 define similar recesses 90 on the opposite side of the assembly 20.

Preferably, the forward reservoir wall 32 includes an enlarged pour spout 92 for directing a flow of liquid from the reservoir 40. However, alternatively, the reservoir 40 can be drained through a drain valve 94 positioned in a lower portion of the back reservoir wall 34. The drain valve 94 is easily accessible from the rear of the assembly 20 through an archway 96, but is otherwise sheltered from accidental bumps that may damage the valve.

As best shown in FIG. 7, the container assembly 20 preferably includes an integral accessory hook 98 that extends generally horizontally from the right hopper side wall 48, and a slot 100 extending along an upper rim of the back reservoir wall 34. The hook 98 is designed to hold janitorial accessories, such as wet floor signs, and the slot is design to hold a cleaning tool, such as a scraper. These features save trips to and from the janitorial closet.

In the preferred embodiment of the container assembly 20 described above, the wringing wall 54 of the wringing mechanism 42 has been shown and described as constituting a part of the back reservoir wall 34, with the wringing surface 56 facing away from the liquid reservoir 40 and into the hopper 44. However, it should be understood that other configurations of the wringing mechanism 42 are possible without departing from the scope of the invention. Preferably, at least a portion of the wringing mechanism 42 and at least one the side walls are of a monolithic construction. However, in alternative embodiments of the invention, the wringing wall 54 of the wringing mechanism 42 may constitute part of the forward reservoir wall 32, left side reservoir wall 36 or right side reservoir wall 38, instead of the back reservoir wall 34. Also, the wringing mechanism could be configured so that the wringing surface 56 generally faces the liquid reservoir 40, rather than away from the liquid reservoir.

Figure 2:
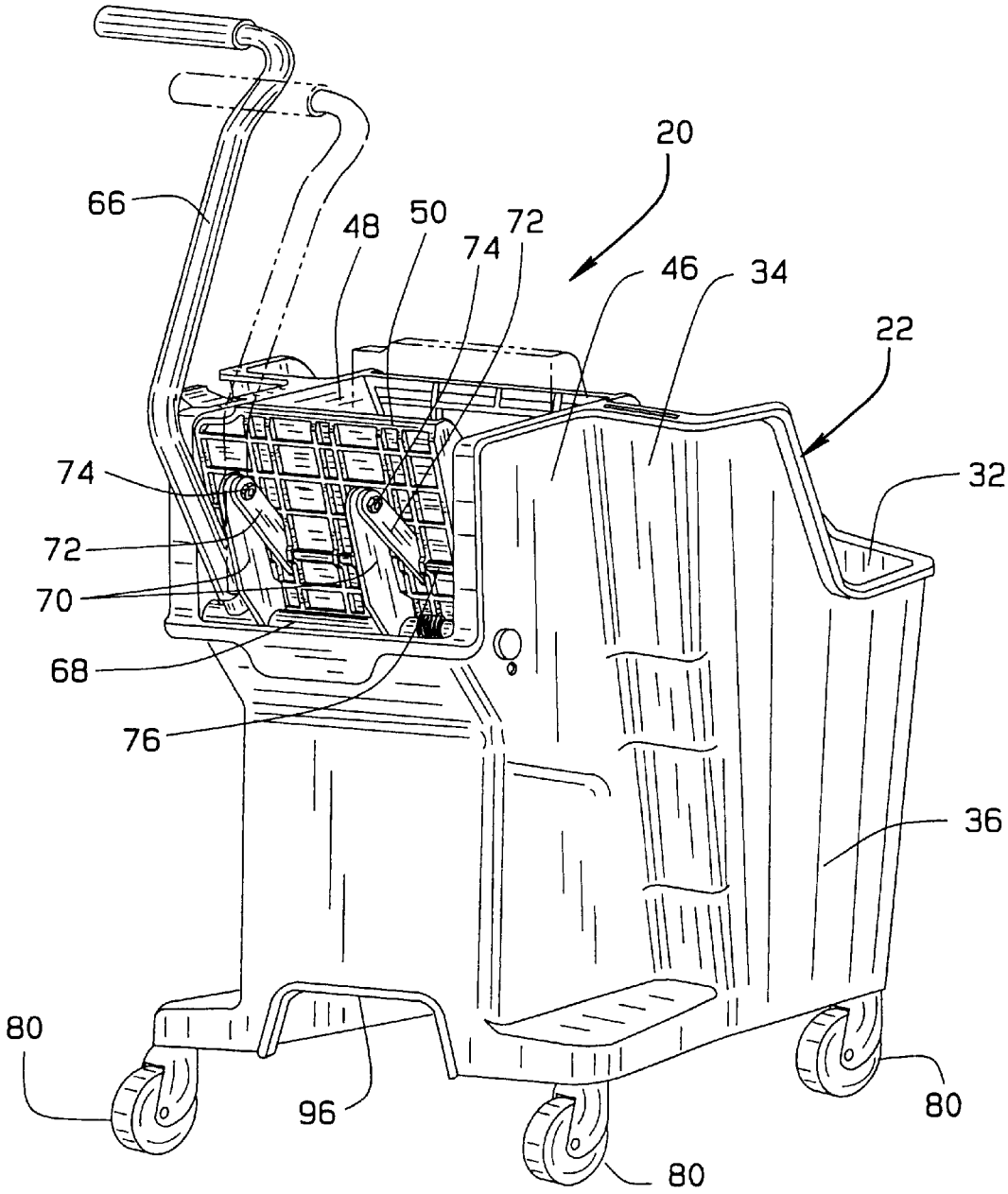
FIG. 2 is a rear and left side perspective view of the container assembly of FIG. 1 with a wringing position of the wringing mechanism shown in phantom.
Figure 3:
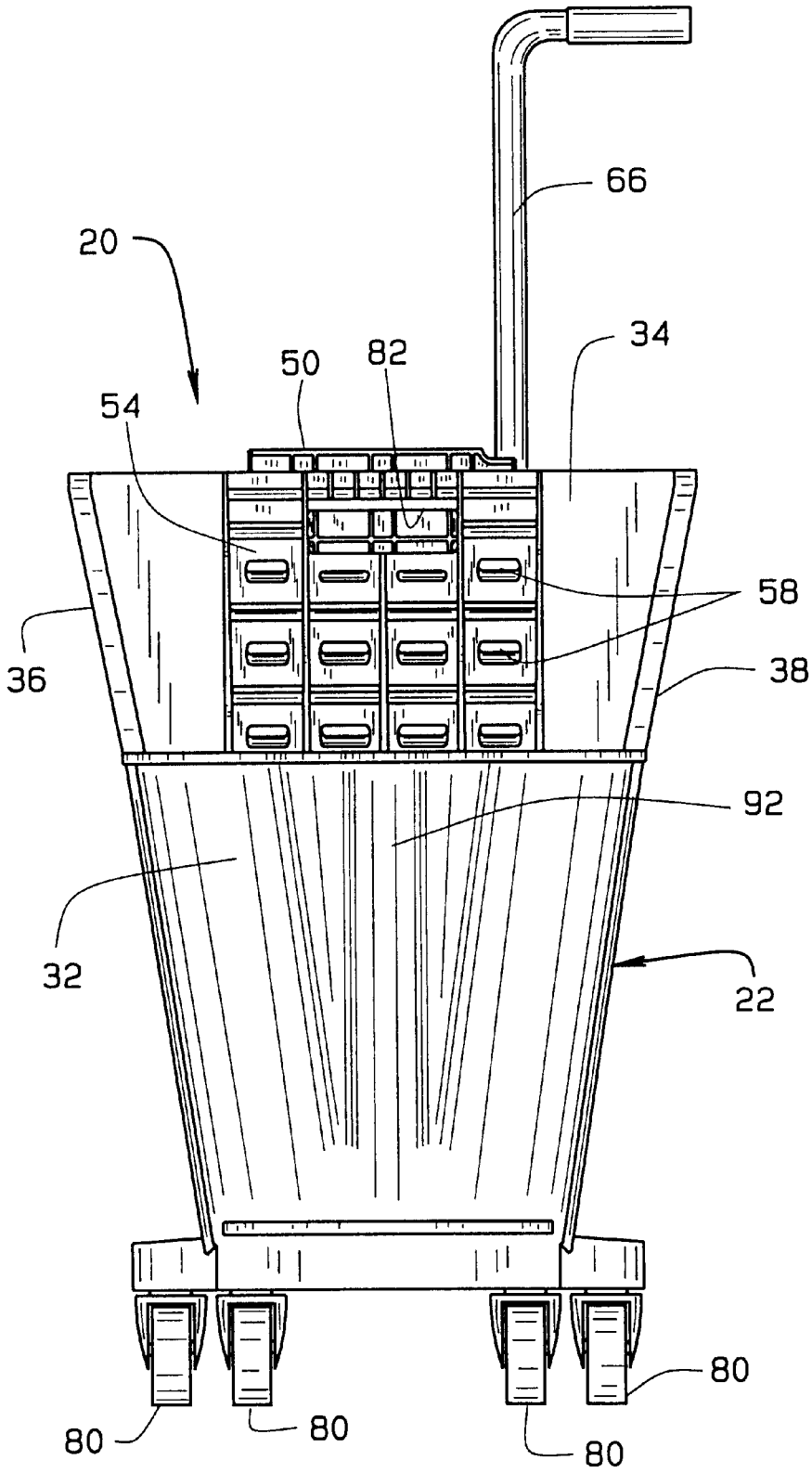
FIG. 3 is a front elevational view of the container assembly of FIG. 1.
Figure 4:
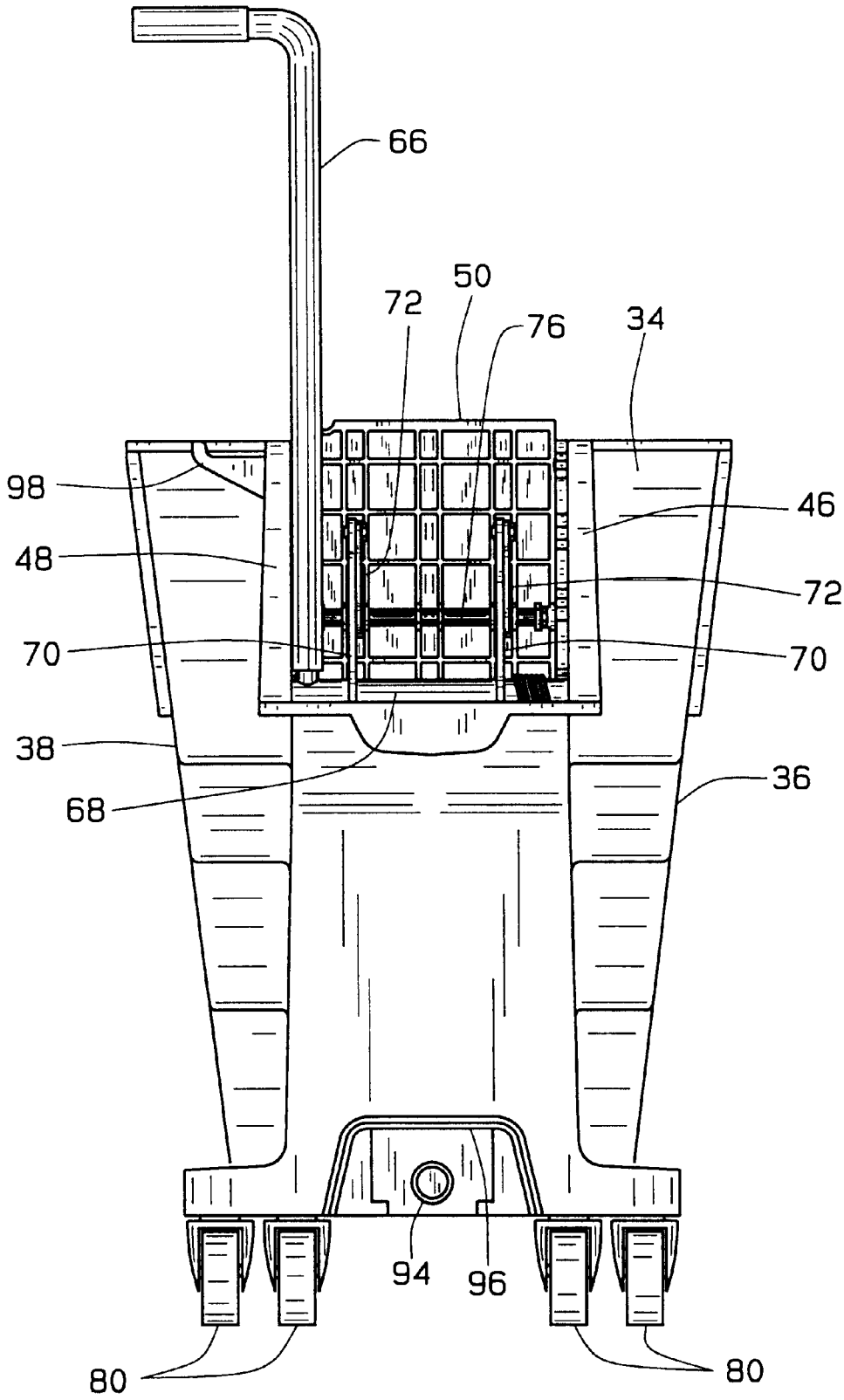
FIG. 4 is a rear elevational view of the container assembly of FIG. 1.
Figure 5:
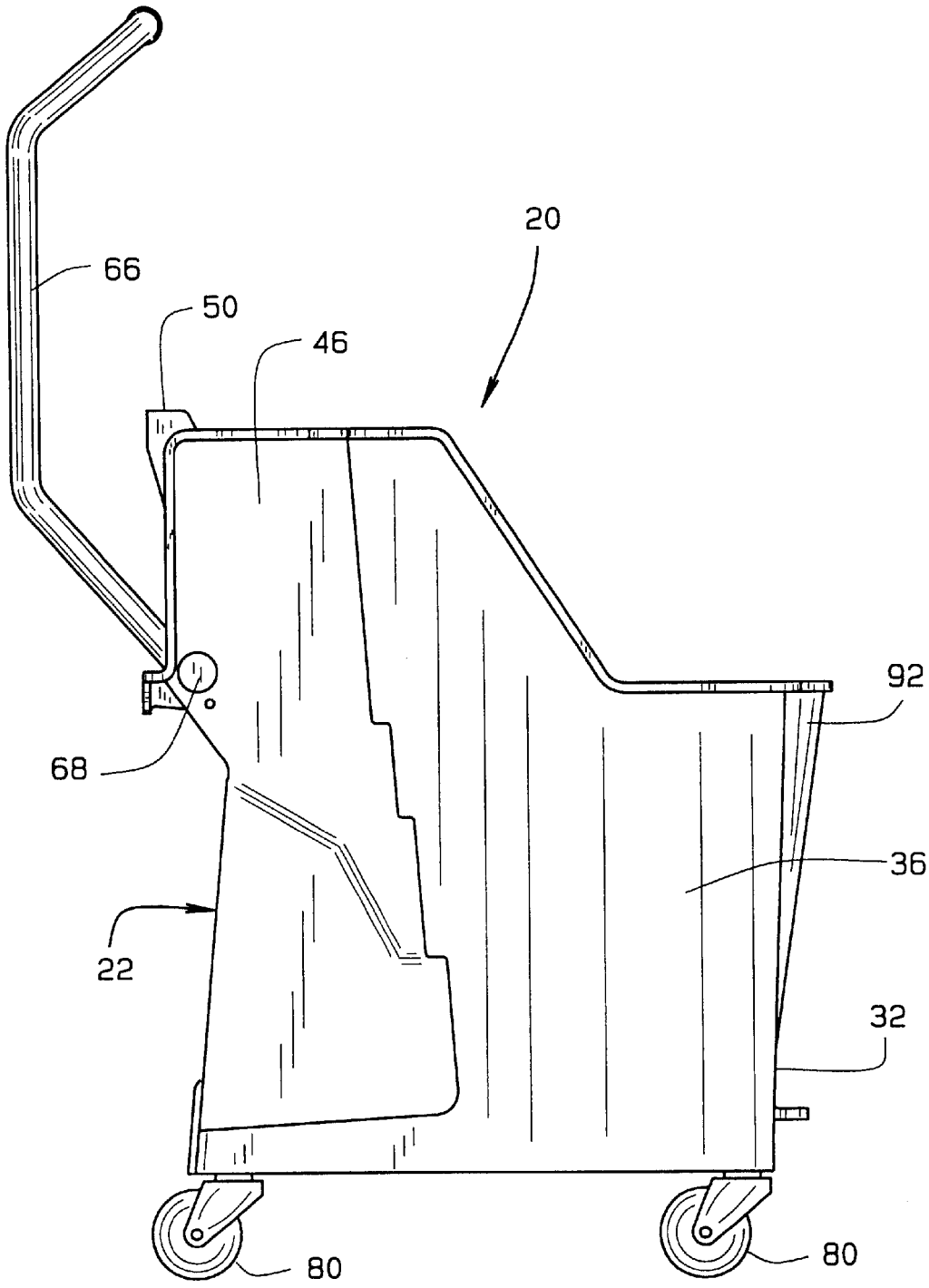
FIG. 5 is a left side elevational view of the container assembly of FIG. 1.
Figure 6:
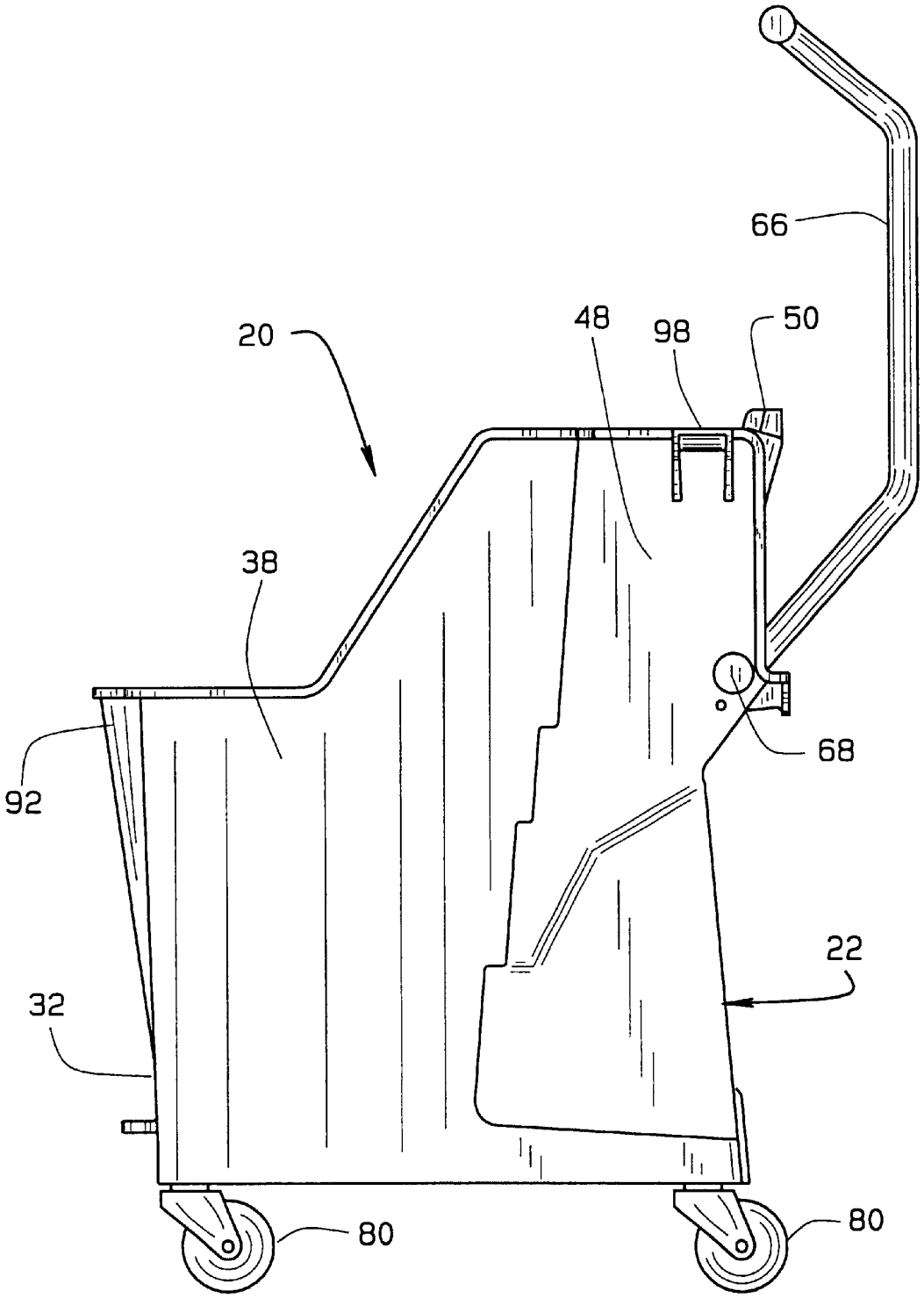
FIG. 6 is a right side elevational view of the container assembly of FIG. 1.

As described above, the wringing mechanism 42 is preferably configured so that the press member 50 moves generally toward the liquid reservoir 40 as it moves from its non-wringing position (shown in solid lines in the Figures) toward its wringing position (shown in phantom in FIGS. 2 and 10). However, it is not critical that the wringing mechanism 42 be configured so that the press member 50 moves toward the liquid reservoir 40 as it moves from its non-wringing position to its wringing position. It should be understood that, in an alternative embodiment of the container assembly 20, the wringing mechanism 42 may be configured so that the press member 50 moves generally away from the liquid reservoir 40 as it moves from a non-wringing position toward a wringing position.

In view of the above, it will be seen that the present invention overcomes problems associated with the prior art and achieves other advantageous results. As various changes could be made without departing from the scope of the invention, it is intended that all matter contained in the above description or shown in the accompanying drawings shall be interpreted as illustrative and not in a limiting sense.

What is claimed is:

1. A container assembly comprising:

a container body having an interior surface that defines a liquid reservoir; and a wringing mechanism adjacent the liquid reservoir, the wringing mechanism including a wringing surface and a press member, the press member being operatively connected to the container assembly for movement of the press member between a wringing position and a non-wringing position relative to the wringing surface, the press member and the wringing surface being configured to wring liquid out of a mop upon movement of the press member from its non-wringing position toward its wringing position when a mop head is positioned between the press member and the wringing surface, the wringing surface and at least a portion of the container body being of a monolithic construction.

2. The container assembly of claim 1 wherein the press member is connected to the container assembly in a manner so that the press member moves generally horizontally relative to the wringing surface as the press member moves between its wringing and non-wringing positions.

3. The container assembly of claim 1 wherein the press member includes a generally planar pressing surface adapted for engaging a mop head positioned between the pressing surface and the wringing surface, the pressing surface being disposed generally vertically when engaging a mop head positioned between the pressing surface and the wringing surface.

4. The container assembly of claim 3 wherein the pressing surface generally faces the wringing surface throughout the entire range of motion of the press member between its wringing and non-wringing positions.

5. The container assembly of claim 1 wherein the press member is pivotally connected to the container body for pivoting movement between its wringing and non-wringing positions.

6. The container assembly of claim 1 wherein the press member is connected to the container assembly in a manner so that the press member moves along an arcuate path as it moves from its non-wringing position to its wringing position.

7. The container assembly of claim 1 wherein the press member is the only press member.

8. The container assembly of claim 1 wherein the wringing mechanism is a sideward wringing mechanism.

9. The container assembly of claim 1 further comprising a moveable arm member operatively connected to the press member in a manner so that movement of the arm member relative to the container body causes movement of the press member between its wringing and non-wringing positions.

10. The container body of claim 9 wherein the moveable arm member is connected to the press member by a four-bar type linkage.

11. A container assembly comprising:

a one-piece container body having an interior surface that defines a liquid reservoir and a wringing surface adjacent the liquid reservoir; and a press member operatively connected to the container body for movement of the press member between a wringing position and a non-wringing position relative to the wringing surface of the container body, the press member and the wringing surface defining a mop receiving volume, the mop receiving volume having a volume $V_1$ when the press member is in its non-wringing position and having a volume $V_2$ when the press member is in its wringing position, the volume $V_2$ being less than the volume $V_1$, the press member and the wringing surface being configured to wring liquid out of a mop upon movement of the press member from its non-wringing position toward its wringing position when a mop head is positioned between the press member and the wringing surface.

12. The container assembly of claim 11 wherein the wringing mechanism is a side-press wringing mechanism.

13. The container assembly of claim 11 wherein the press member is connected to the container assembly in a manner so that the press member moves generally horizontally toward the wringing surface as it moves from its non wringing position toward its wringing position.

14. The container assembly of claim 11 wherein the press member includes a generally planar pressing surface adapted for engaging a mop head positioned between the pressing surface and the wringing surface, the pressing surface being disposed generally vertically when engaging a mop head positioned between the pressing surface and the wringing surface.

15. The container assembly of claim 14 wherein the pressing surface generally faces the wringing surface throughout the entire range of motion of the press member between its wringing and non-wringing positions.

16. The container assembly of claim 11 wherein the press member is connected to the container assembly in a manner so that the press member moves along a continuously arcuate path as it moves from its non-wringing position to its wringing position.

17. The container assembly of claim 11 wherein the press member is the only press member.

18. The container assembly of claim 11 further comprising a moveable arm member operatively connected to the press member by a four-bar type linkage in a manner so that movement of the arm member relative to the container body causes movement of the press member between its wringing and non-wringing positions.

* * * * *